US006502706B1

(12) United States Patent
Kent

(10) Patent No.: US 6,502,706 B1
(45) Date of Patent: Jan. 7, 2003

(54) MERCHANDISE DISPLAY

(75) Inventor: Wayne Kent, Tyler, TX (US)

(73) Assignee: Knight Manufacturing Co., Inc., Tyler, TX (US)

( * ) Notice: Subject to any disclaimer, the term of this patent is extended or adjusted under 35 U.S.C. 154(b) by 0 days.

(21) Appl. No.: 09/836,676

(22) Filed: Apr. 16, 2001

(51) Int. Cl.[7] ..... A47F 5/08

(52) U.S. Cl. ..... 211/87.01; 211/57.1; 248/220.42; 248/220.22

(58) Field of Search ..... 248/220.31, 220.41, 248/220.51, 220.21, 220.43, 221.11, 222.51, 223.31, 225.21; 211/106, 103, 59.1, 57.1, 87.01

(56) References Cited

U.S. PATENT DOCUMENTS 4,094,415 A * 6/1978 Larson ..... 211/57.1
4,450,970 A * 5/1984 Shepherd ..... 211/189
4,452,360 A * 6/1984 Barnes ..... 211/59.1
4,463,510 A * 8/1984 Windish ..... 211/54.1
4,687,094 A * 8/1987 Allsop et al. ..... 206/45.26
4,688,683 A * 8/1987 Thalenfeld et al. ..... 211/57.1
4,707,940 A 11/1987 Franklin ..... 40/605
4,708,311 A * 11/1987 Clausen et al. ..... 211/87.01
4,783,033 A * 11/1988 Valiulis ..... 211/59.1
5,012,997 A * 5/1991 Hutchison ..... 211/59.1
5,086,935 A * 2/1992 Gallagher ..... 211/103
5,188,326 A * 2/1993 Zich ..... 248/220.41
5,305,898 A 4/1994 Merl ..... 211/87
5,348,167 A * 9/1994 Jensen ..... 211/57.1
5,443,167 A 8/1995 Menaged et al. ..... 211/87
5,547,088 A * 8/1996 Belokin et al. ..... 211/103
5,595,309 A * 1/1997 Bauer et al. ..... 211/59.1
5,769,248 A * 6/1998 Johnson ..... 211/103
5,927,517 A * 7/1999 Lipman et al. ..... 211/106
5,957,422 A 9/1999 Shea ..... 248/220.32
6,015,124 A * 1/2000 Loy ..... 248/220.31
6,070,747 A 6/2000 Shea ..... 211/87.01
6,199,706 B1 * 3/2001 Shea ..... 211/103
6,234,436 B1 * 5/2001 Kump ..... 211/59.1

* cited by examiner

*Primary Examiner*—Daniel P. Stodola
*Assistant Examiner*—Jennifer E. Novosad
(74) *Attorney, Agent, or Firm*—Charles M. Kaplan

(57) ABSTRACT

Peg board merchandise display space expanders increase usable display space by attaching flat panels having holes of the same size and separation as those in peg board to vertical channels with downwardly extending clasps that are inserted into slots in the channels. Misalignment with existing peg board displays may be prevented by support stabilizers that fit into the channel slots.

19 Claims, 5 Drawing Sheets

MERCHANDISE DISPLAY

BACKGROUND OF THE INVENTION

This invention relates to merchandise displays, and in particular to peg board displays that may be combined with shelving. Adjustable shelves are commonly supported on slotted vertical channels. Shelf support brackets are inserted into the slots in the channels, and the location of the shelves can be changed by moving the supporting brackets to different slots in the channels. The unused portion of the channels between shelves is not easily usable for peg board type display of merchandise, and when shelves are entirely removed the full length of a channel may be wasted for merchandise display purposes.

OBJECTIVES OF THE INVENTION

Accordingly, it is an object of this invention to provide improved merchandise displays.

Another object is to provide removable attachments that increase peg board display surface areas.

An additional object is to provide product display enhancement devices for store displays that permit the use of existing product display hardware.

Another object is to provide product display expanding units that can be used and then removed and stored for use again and again.

A further object is to provide peg board display enhancers that have holes that can be aligned with the holes in a permanent peg board display.

Another object is to provide display expanders for stacking and dispensing numerous product units.

Another object is to prevent displayed product from looking disorderly because of misalignment of display devices.

A further object is to provide product display equipment that is durable, economical, highly attractive, easy to use and maintain, and which do not possess defects found in similar prior art merchandise display attachments.

Other objects and advantages of the merchandise displays incorporating this invention will be found in the specification and claims and the scope of the invention will be set forth in the claims.

DESCRIPTION OF THE INVENTION

Figure 1:
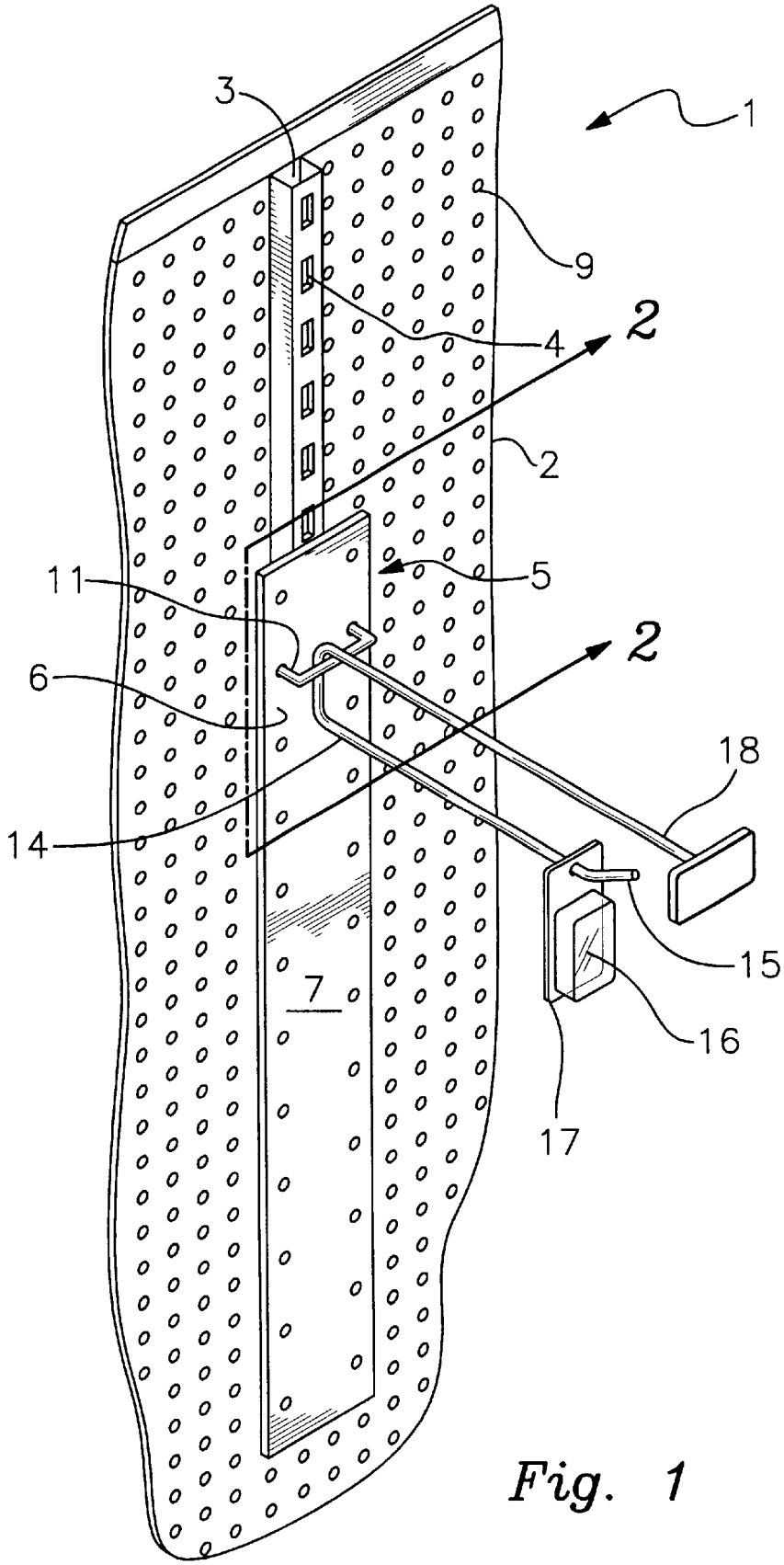
FIG. 1 is a perspective schematic view of an embodiment of a merchandise display in accord with this invention.

The drawing shows a merchandise display 1 in accord with this invention that includes panels 2 of conventional peg board having holes uniformly spaced at predetermined intervals and conventional vertical shelf support channels 3 having slots 4 for shelf support hardware. The space occupied by the channels 3 and the adjacent peg board surface area is often not available for display of merchandise.

This invention includes the use of merchandise display expanders 5 whose length and width may be varied to optimally increase the usable peg board space in any specific store. Expanders 5 should be strong and unbendable, and may be made from any flat rigid material such as sheet steel or aluminum, or hard sheet plastic material such as PVC or nylon. Each expander thus will include a hard rigid panel 6 having a front planar surface 7 and a rear planar surface 8. Holes 10 through panel 6 may have the same size and spacing arrangement as the holes 9 in the peg board used in the particular merchandise display being enhanced by use of this invention.

Conventional hardware can be used to display additional merchandise on expanders 5. For example, a clasp 11 that has a pair of prongs 12 may be used to support a merchandise holder 14 that has a lower arm 15 for holding products 16 mounted on cards 17 and an upper arm 18 for price display. The prongs 12 pass through a pair of holes 10 and bear against the panel rear surface 8.

The expanders 5 are held on the channels 3 by at least one pair of integral anchors 20 that are permanently attached to the rear surface 8 at vertically aligned spaced locations. Each anchor includes a downwardly extending clasp 21 that holds the panel on a channel 3. The spacing between the anchors 20 corresponds to a multiple of the spacing between the slots 4, so that the clasps 21 will always be positioned to enter a pair of the slots to attach the expander 5 to a channel 3.

Each expander 5 also includes an integral spacer disk 23 that has one edge 24 attached to the expander rear surface 8. The opposite edge 25 of each disk 23 will engage the shelf support channel 3 when the expander 5 is in place. This will ensure that the panel 6 will be spaced from the channel and the adjacent peg board a predetermined minimum distance D. The distance D must be sufficient to permit insertion of support hardware prongs, such as the prongs 12, through the holes 10 without interference with the channel 3 or adjacent peg board 2. The distance D must also give the hardware prongs enough clearance to move or adjust to the final positions the prongs occupy against the rear surface 8, and permit removal of the prongs when the display is changed.

Figure 7:
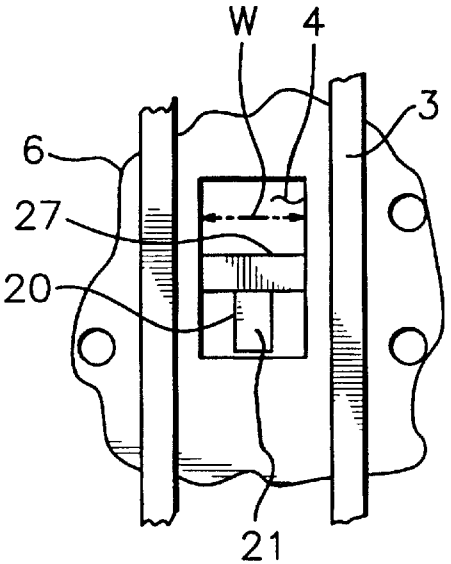
FIG. 7 is an enlarged end view taken corresponding to FIG. 6 showing another embodiment of the invention.
Figure 6:
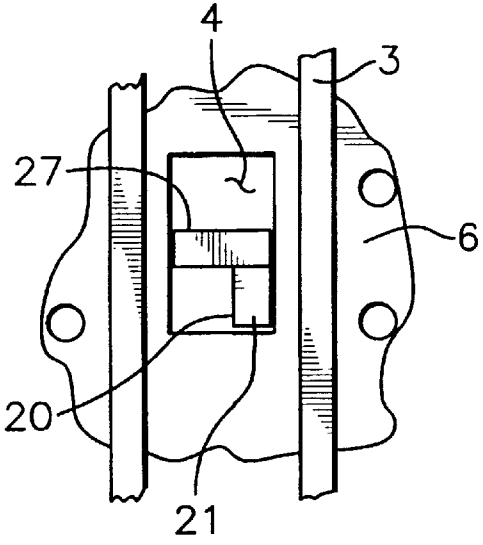
FIG. 6 is an enlarged end view taken generally along the line 6—6 in FIG. 2 showing one embodiment of the invention.
Figure 2:
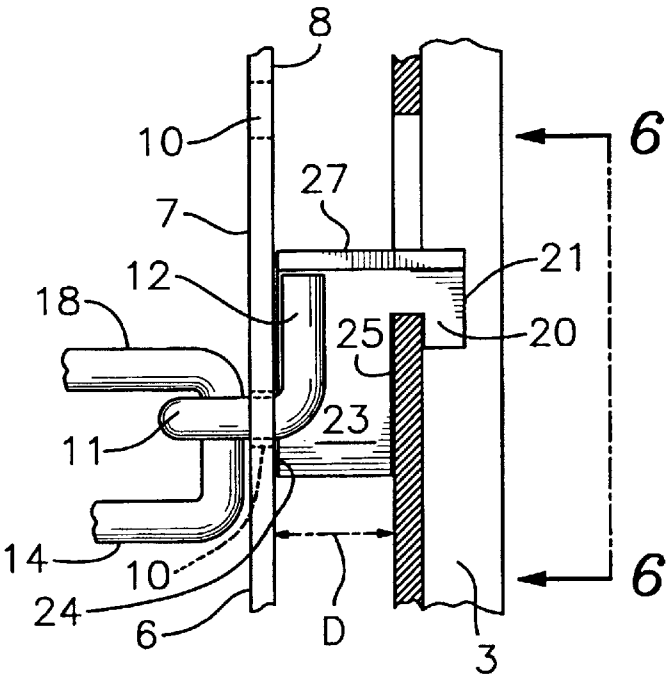
FIG. 2 is an enlarged, partially cross sectional side view taken generally along the 2—2 in FIG. 1.
Figure 3:
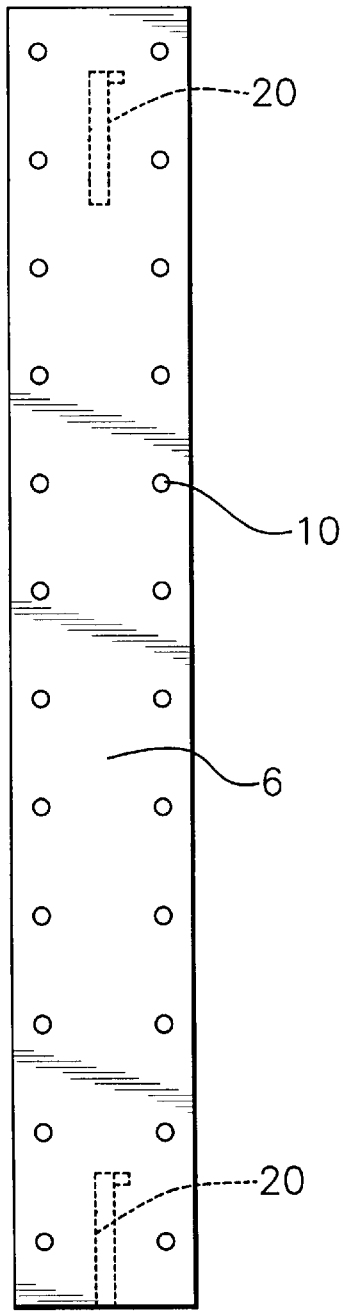
FIG. 3 is a is an enlarged plan view of a display expander in accord with this invention.
Figure 4:
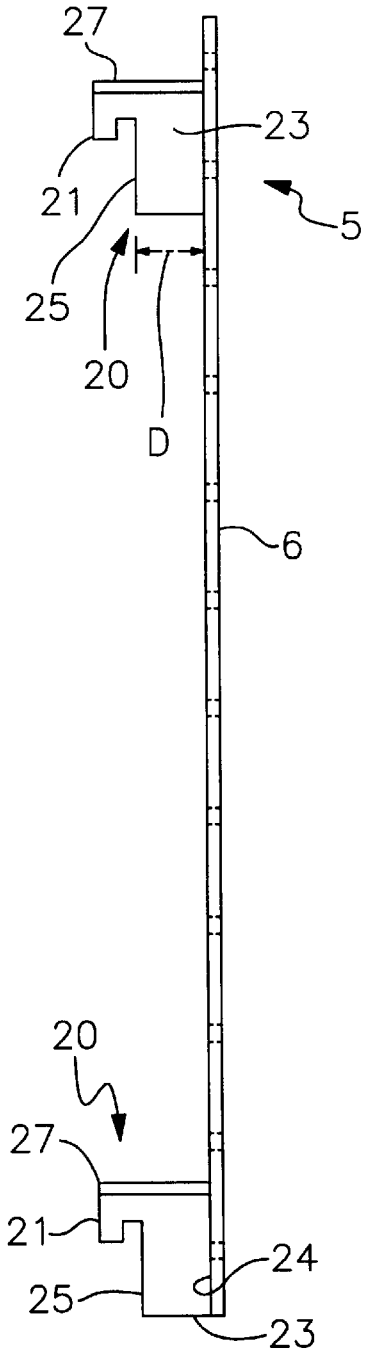
FIG. 4 is a side view of the display expander shown in FIG. 3.
Figure 5:
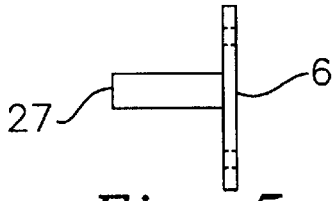
FIG. 5 is a top view of the display expander shown in FIG. 3.
Figure 8:
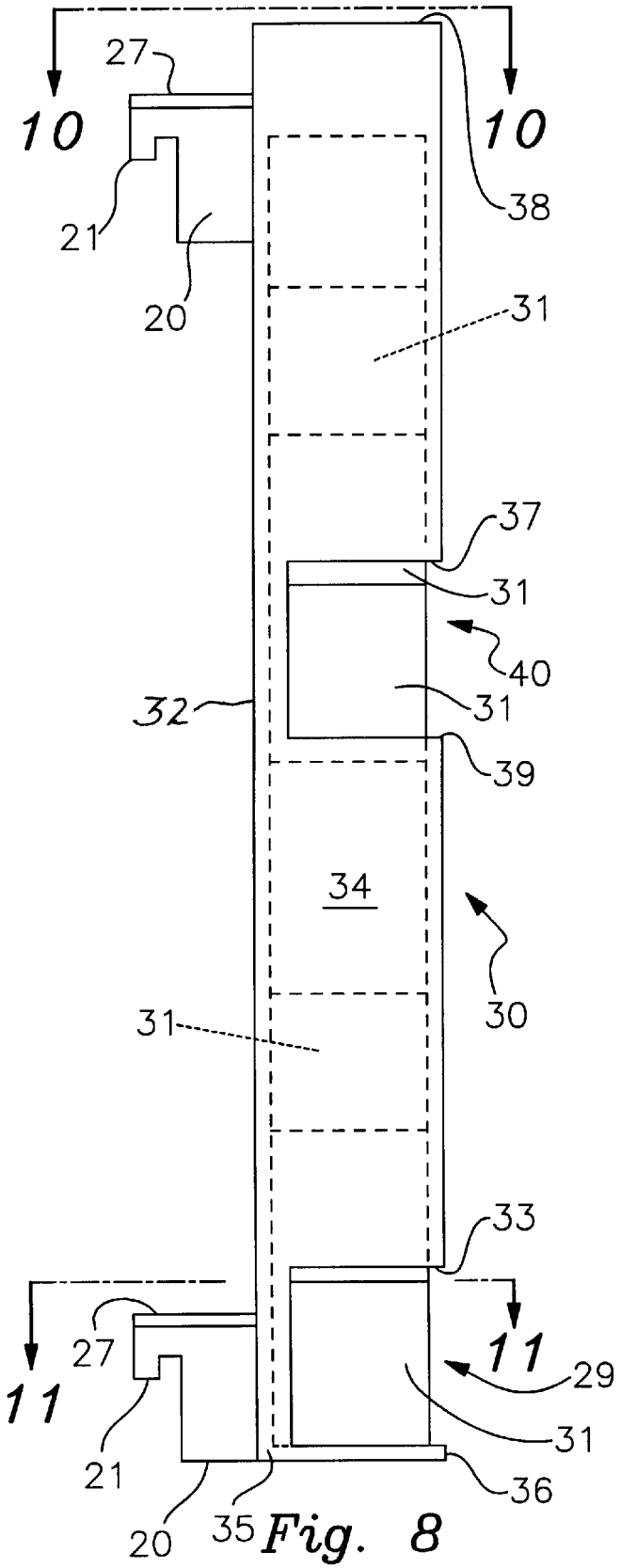
FIG. 8 is a schematic side view showing another embodiment of a display expander in accord with this invention.
Figure 9:
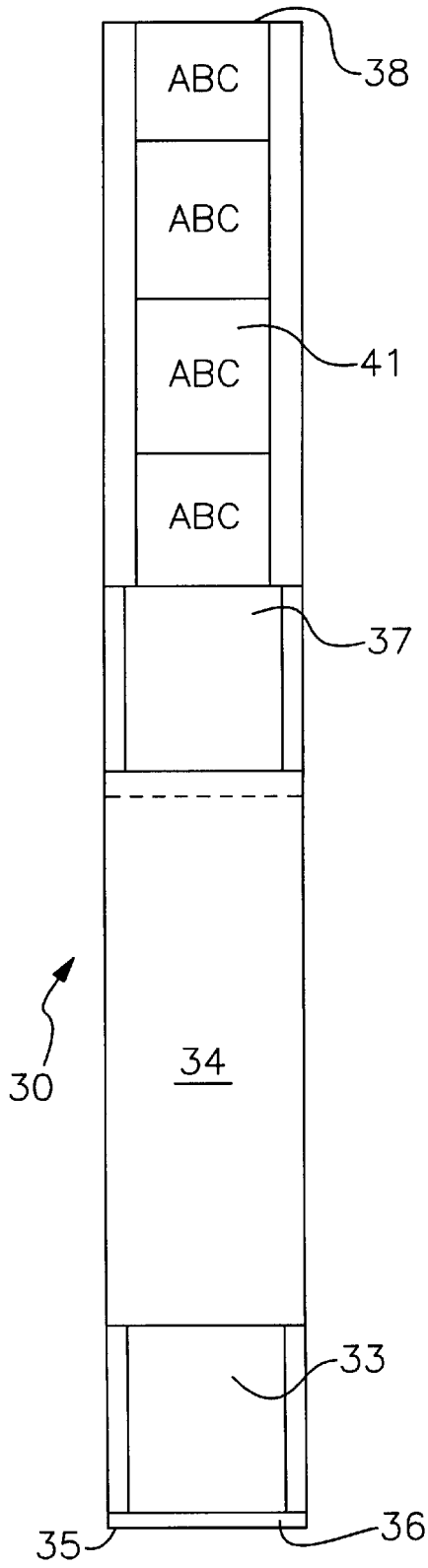
FIG. 9 is a front view of the embodiment of FIG. 8 omitting the product units.

Each expander 5 may be provided with integral stabilizer bars 27 at the upper end of the anchors 20. The channel slots 4 will have some predetermined width W. The stabilizer bars 27 have essentially the same width W minus an amount necessary to permit insertion of the stabilizer bars into the slots 4. As shown in FIG.6, a stabilizer bar may define an essentially L-shaped end section with its anchor 20. As shown in FIG. 7, a stabilizer bar may define an essentially T-shaped end section with its anchor. The anchors 20 are narrower that the width W of the slots 4. The stabilizer bars 27 are located above the bottom of the slots 4 when the clasps 21 are engaged. The stabilizer bars prevent the anchors 20 from moving around in the slots 4. This stabilizes the position and orientation of the expander 5 and prevents, or at least minimizes, misalignment of the holes 10 with the holes in the peg board 2. This prevents misalignment of the expander 5 and the products displayed thereon, which makes the displayed product look neat and orderly, and uses the display space more efficiently.

FIGS. 8–12 show additional embodiments of display expanders 30 in which stacks of individual product units 31 are stored and displayed in an open topped, hollow tube 32, which may be made from any rigid cylindrical material such as steel or aluminum tubing, or a hard plastic such as PVC or nylon tubing. The tubes 32 are removably attached in the holes 4 of the shelf support channels 3 in the same manner described above with respect to FIGS. 1–7. The units 31 and the tube 32 may be right circular cylinders.

Tube 32 has an opening 33 through is outer wall 34 adjacent its bottom end 35. A shelf 36 closes the tube below the opening 33 for supporting a first stack 29 made up of a number of the product units 31. One or more additional openings 37 may be located between the top open end 38 of tube 32 and the opening 33. Each of the additional openings will have another shelf 39 that closes the tube below such additional opening for supporting an other additional stack 40 of the product units.

The openings 33 and 37 are dimensioned larger than a predetermined product unit size and extend more than 180 degrees around the circumference of the tube so as to permit quick and easy insertion and removal of of the product units 31. Product units may be loaded upwardly through the openings 33 and 37 or downwardly through the open top end 38. Labels 41 that show or identify the product being dispensed may be affixed to the outside of the tube 32.

The tubes 32 are held on the channels 3 by at least one pair of integral anchors 20, identical to those of FIGS. 1–7, that are permanently attached to the rear surface of the outer wall 34 at vertically aligned spaced locations. Each anchor includes a downwardly extending clasp 21 that holds the tube on a channel 3. The spacing between the anchors 20 corresponds to a multiple of the spacing between the slots 4, so that the clasps 21 will always be positioned to enter a pair of the slots to attach the tube 32 to a channel 3.

Each tube 32 may be provided with integral stabilizer bars 27 at the upper end of the anchors 20 that are identical to the stabilizer bars described above. A stabilizer bar may define an essentially L-shaped end section with its anchor 20 like the one in FIG. 6, or an essentially T-shaped end section with its anchor like the one in FIG. 7. The stabilizer bars prevent the anchors 20 from moving around in the slots 4. This stabilizes the position and orientation of the tube 32 and prevents, or at least minimizes, misalignment of the tube 32 and the products displayed thereon, which makes the displayed product look neat and orderly, and uses the display space more efficiently.

Figure 12:
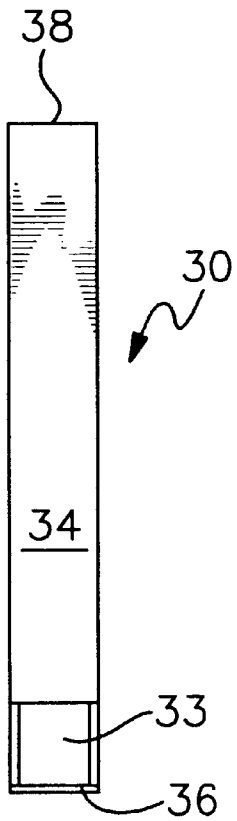
FIG. 12 is a schematic front view of another embodiment of a display expander in accord with this invention.
Figure 11:
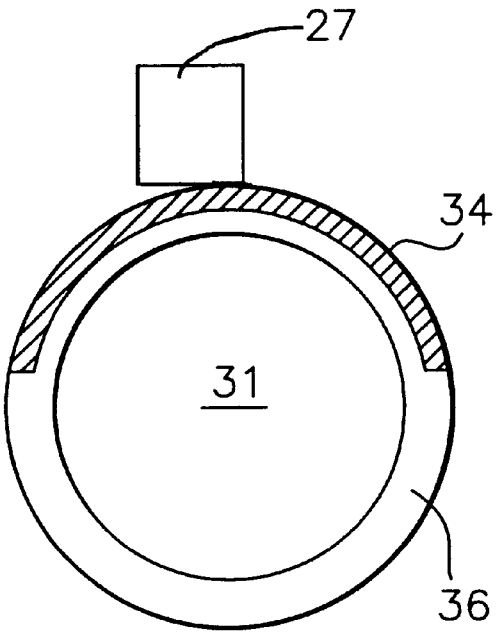
FIG. 11 is an enlarged cross section taken generally along the line 11—11 in FIG. 8.
Figure 10:
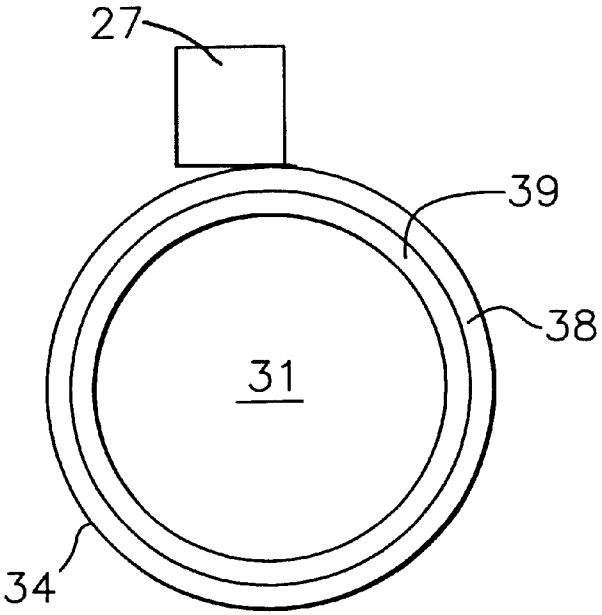
FIG. 10 is an enlarged end view taken generally along the line 10—10 in FIG. 8.

The embodiment of FIG. 12 is identical to the embodiment of FIGS. 8–11 except that this embodiment has only one opening 33 and that opening is located adjacent its bottom end 35.

While the present invention has been described with reference to particular embodiments, it is not intended to illustrate or describe all of the equivalent forms or ramifications thereof Also, the words used are words of description rather than limitation, and various changes may be made without departing from the spirit or scope of the invention disclosed herein. It is intended that the appended claims cover all such changes as fall within the true spirit and scope of the invention.

I claim:

1. In a merchandise display comprising peg board having holes of a predetermined size essentially uniformly spaced at predetermined intervals, and a vertical shelf support channel having vertical slots aligned at uniformly spaced intervals, and said slots having a predetermined width; the improvement in a merchandise display expander comprising a flat rigid panel having front and rear planar surfaces, said panel having holes therethrough, the panel holes being of the same predetermined size as the holes of the peg board, and said panel holes being spaced uniformly at the same predetermined intervals as said peg board holes, a pair of panel anchors attached to said planar rear surface of said panel at vertically spaced locations that enable said anchors to be aligned with pairs of slots in said channel, each said anchor comprising a downwardly extending clasp for entering a slot in said shelf support channel and engaging said shelf support channel so as to support said panel thereon; and a spacer disk having one edge attached to said rear surface of said panel and an opposite edge for engaging said shelf support channel so as to position said rear surface of said panel away from said shelf support channel a predetermined distance.

2. The merchandise display expander defined in claim 1 wherein there is a separate spacer disk integral with each of said panel anchors.

3. The merchandise display expander defined in claim 2, further comprising a stabilizer bar at an upper end of each anchor for entering one of said slots.

4. The merchandise display expander defined in claim 3 wherein each of the stabilizer bars substantially fills the width of the slot it enters.

5. The merchandise display expander defined in claim 3 wherein each stabilizer bar is integral with its anchor and defines an essentially T-shaped end section with its anchor.

6. The merchandise display expander defined in claim 3 wherein each stabilizer bar is integral with its anchor and defines an essentially L-shaped end section with its anchor.

7. The merchandise display expander defined in claim 3 wherein each stabilizer bar is located above the bottom of a slot when its clasp is engaged with said channel.

8. A merchandise display comprising: peg board having holes of a predetermined size essentially uniformly spaced at predetermined intervals; a vertical shelf support channel having vertical slots aligned at uniformly spaced intervals, said slots having a predetermined width; a merchandise display expander comprising a flat rigid panel having front and rear planar surfaces, said panel having holes therethrough, the panel holes being of the same predetermined size as the peg board holes, and said panel holes being spaced uniformly at the same predetermined intervals as said peg board holes, a pair of panel anchors attached to said planar rear surface of said panel at vertically spaced locations that enable said anchors to be aligned with pairs of slots in said channel, each anchor comprising a downwardly extending clasp for entering a slot in said shelf support channel and engaging said shelf support channel so as to support said panel thereon; a spacer disk having one edge attached to said rear surface of said panel and an opposite edge for engaging said shelf support channel so as to position said rear surface of said panel away from said shelf support channel a predetermined distance that is large enough to permit insertion of merchandise display support hardware through said holes in said panel; and merchandise display support hardware having prongs extending through said holes in said panel and engaging the rear surface of said panel.

9. The merchandise display defined in claim 8 wherein there is a separate spacer disk integral with each of said panel anchors.

10. The merchandise display defined in claim 9, further comprising a stabilizer bar at an upper end of each anchor for entering one of said slots.

11. The merchandise display defined in claim 10 wherein each of the stabilizer bars substantially fills the width of the slot it enters.

12. The merchandise display defined in claim 10 wherein each stabilizer bar is integral with its anchor and defines an essentially T-shaped end section with its anchor.

13. The merchandise display defined in claim 10 wherein each stabilizer bar is integral with its anchor and defines an essentially L-shaped end section with its anchor.

14. The merchandise display defined in claim 10 wherein each stabilizer bar is located above the bottom of its associated slot when its clasp is engaged with said channel.

15. A merchandise display expander for increasing the peg board display surface area of a peg board display that has holes of a predetermined size that are uniformly spaced in rows at predetermined intervals, said merchandise display expander comprising a flat rigid panel having front and rear planar surfaces, said panel having holes therethrough that are of the same predetermined size and spaced in rows at the same uniformly spaced intervals as the holes of the peg board, a pair of panel anchors attached to said planar rear surface of said panel at vertically spaced locations, each anchor comprising a downwardly extending clasp for holding said panel on a shelf support channel; a spacer disk integral with each anchor, each spacer disk having one edge attached to said rear surface of said panel and an opposite edge for engaging said shelf support channel so as to position said rear surface of said panel a predetermined distance away from said shelf support channel; and an integral stabilizer bar at an upper end of each anchor.

16. The merchandise display expander defined in claim 15 wherein the each stabilizer bar is arranged for engaging a slot in a shelf support channel.

17. The merchandise display expander defined in claim 16 wherein each stabilizer bar is located above the bottom of a shelf support channel slot when its clasp is engaged with a shelf support channel.

18. The merchandise display expander defined in claim 15 wherein the stabilizer bar defines an essentially T-shaped end section with its anchor.

19. The merchandise display expander defined in claim 15 wherein each stabilizer bar defines an essentially L-shaped end section with its anchor.

* * * * *